US008302404B2

(12) United States Patent
Nilsson et al.

(10) Patent No.: US 8,302,404 B2
(45) Date of Patent: Nov. 6, 2012

(54) SWIRLER FOR USE IN A BURNER OF A GAS TURBINE ENGINE

(75) Inventors: Ulf Nilsson, Whetstone (GB); Nigel Wilbraham, Stourbridge (GB)

(73) Assignee: Siemens Aktiengesellschaft, München (DE)

( * ) Notice: Subject to any disclaimer, the term of this patent is extended or adjusted under 35 U.S.C. 154(b) by 662 days.

(21) Appl. No.: 12/224,242

(22) PCT Filed: Feb. 15, 2007

(86) PCT No.: PCT/EP2007/051469

§ 371 (c)(1),
(2), (4) Date: Aug. 21, 2008

(87) PCT Pub. No.: WO2007/096294

PCT Pub. Date: Aug. 30, 2007

(65) Prior Publication Data

US 2009/0025395 A1 Jan. 29, 2009

(30) Foreign Application Priority Data

Feb. 22, 2006 (GB) ..... 0603488.8

(51) Int. Cl.
*F02C 1/00* (2006.01)
*F02G 3/00* (2006.01)

(52) U.S. Cl. ..... 60/748; 239/399; 431/8; 60/740; 60/737

(58) Field of Classification Search ..... 60/748, 60/752, 754–760; 239/399; 431/8, 9, 181, 431/350

See application file for complete search history.

(56) References Cited

U.S. PATENT DOCUMENTS

| | | | | |
|---|---|---|---|---|
| 3,605,407 | A | 9/1971 | Bryce | |
| 3,980,233 | A * | 9/1976 | Simmons et al. | 239/400 |
| 5,319,935 | A * | 6/1994 | Toon et al. | 60/733 |
| 5,407,347 | A | 4/1995 | Bortz | |
| 5,647,200 | A | 7/1997 | Althaus | |
| 6,094,916 | A * | 8/2000 | Puri et al. | 60/737 |
| 6,146,130 | A * | 11/2000 | Sarv et al. | 431/184 |
| 6,151,899 | A | 11/2000 | Park | |
| 6,253,555 | B1 | 7/2001 | Willis | |
| 6,655,145 | B2 * | 12/2003 | Boardman | 60/737 |
| 6,895,756 | B2 | 5/2005 | Schmotolocha et al. | |
| 2003/0172655 | A1 | 9/2003 | McCormick | |
| 2004/0050061 | A1 | 3/2004 | Schmotolocha et al. | |
| 2005/0178104 | A1 | 8/2005 | Edelman | |
| 2005/0268618 | A1 | 12/2005 | Johnson | |

FOREIGN PATENT DOCUMENTS

EP 0619457 A1 10/1994

(Continued)

*Primary Examiner* — William H Rodriguez
*Assistant Examiner* — Carlos A Rivera

(57) ABSTRACT

Disclosed is a swirler for use in a burner of a gas turbine engine, the swirler comprising a plurality of vanes arranged in a circle, flow slots being defined between adjacent vanes in the circle, each flow slot having an inlet end and an outlet end, in use of the swirler a flow of fuel and air travelling along each flow slot from its inlet end to its outlet end such that the swirler provides a swirling mix of the fuel and air, at least one vane having an edge adjacent an inlet end of a flow slot configured to generate within the flow slot one or more flow vortices that extend along the slot thereby to enhance mixing of the fuel and air travelling along the slot.

11 Claims, 5 Drawing Sheets

FOREIGN PATENT DOCUMENTS

| | | | |
|---|---|---|---|
| EP | 0936406 | A2 | 8/1999 |
| EP | 1139021 | A2 | 10/2001 |
| FR | 1160902 | A | 8/1958 |
| JP | 4187909 | A | 7/1992 |
| JP | 7332621 | A | 12/1995 |
| JP | 11337069 | A | 12/1999 |
| JP | 2004263695 | A | 9/2004 |
| WO | WO 9717574 | A1 | 5/1997 |

* cited by examiner

SWIRLER FOR USE IN A BURNER OF A GAS TURBINE ENGINE

CROSS REFERENCE TO RELATED APPLICATIONS

This application is the US National Stage of International Application No. PCT/EP2007/051469, filed Feb. 15, 2007 and claims the benefit thereof. The International Application claims the benefits of British application No. 0603488.8 filed Feb. 22, 2006, both of the applications are incorporated by reference herein in their entirety.

FIELD OF INVENTION

The present invention relates to a swirler for use in a burner of a gas turbine engine.

More particularly the present invention relates to such a swirler comprising a plurality of vanes arranged in a circle, flow slots being defined between adjacent vanes in the circle, each flow slot having an inlet end and an outlet end, in use of the swirler a flow of fuel and air travelling along each flow slot from its inlet end to its outlet end such that the swirler provides a swirling mix of the fuel and air.

BACKGROUND OF THE INVENTION

It is desired to improve the mixing of fuel and air that takes place in the flow slots thereby to improve the mix of fuel and air in the swirling mix provided by the swirler.

SUMMARY OF INVENTION

According to the present invention there is provided a swirler for use in a burner of a gas turbine engine, the swirler comprising a plurality of vanes arranged in a circle, flow slots being defined between adjacent vanes in the circle, each flow slot having an inlet end and an outlet end, in use of the swirler a flow of fuel and air travelling along each flow slot from its inlet end to its outlet end such that the swirler provides a swirling mix of the fuel and air, at least one vane having an edge adjacent an inlet end of a flow slot configured to generate within the flow slot one or more flow vortices that extend along the slot thereby to enhance mixing of the fuel and air travelling along the slot.

In a radial swirler according to the preceding paragraph, it is preferable that the edge adjacent an inlet end of a flow slot comprises a plurality of portions, each portion being configured to facilitate a respective flow velocity there past.

In a swirler according to the preceding paragraph, it is preferable that the edge adjacent comprises two portions: a first relatively sharp portion and a second relatively smooth portion.

In a swirler according to the preceding paragraph, it is preferable that the sharp portion is considerably shorter than the smooth portion.

In a swirler according to either of the preceding two paragraphs, it is preferable that each flow slot has a base and a top that extend (i) between the adjacent vanes defining the slot and (ii) along the slot from its inlet to its outlet ends, the sharp portion of the edge adjacent the inlet end of the slot being disposed adjacent the base of the slot, the smooth portion of the edge adjacent the inlet end of the slot being disposed adjacent the top of the slot, and that fuel is supplied to at least one slot at its base.

In a swirler according to any one of the preceding three paragraphs, it is preferable that each vane has an edge adjacent an inlet end of a flow slot that is sharp along its entire length.

In a swirler according to the preceding paragraph, it is preferable that fuel is supplied to at least one flow slot from the vicinity of the edge adjacent the flow slot that is sharp along its entire length.

In a swirler according to any one of the preceding four paragraphs but one, it is preferable that fuel is supplied to at least one flow slot from the smooth portion of the edge adjacent the inlet end of the flow slot.

In a swirler according to any one of the preceding four paragraphs but two, it is preferable that fuel is supplied to at least one flow slot from both the sharp and smooth portions of the edge adjacent the inlet end of the flow slot.

In a swirler according to any one of the preceding four paragraphs but three, it is preferable that fuel is supplied to at least one flow slot from a ledge that separates the sharp and smooth portions of the edge adjacent the inlet end of the flow slot.

In a swirler according to the preceding paragraph but eight, it is preferable that the edge adjacent comprises three portions: two relatively sharp portions separated by a relatively smooth portion, and fuel is supplied to at least one flow slot from the smooth portion.

In a swirler according to the preceding paragraph but nine, it is preferable that the edge adjacent comprises three portions: two relatively sharp portions separated by a further relatively sharp portion not contiguous with the two sharp portions, and fuel is supplied to at least one flow slot from the further sharp portion.

In a swirler according to the preceding paragraph but ten, it is preferable that the edge adjacent comprises three portions: two relatively smooth portions separated by a relatively sharp portion, and fuel is supplied to at least one flow slot from the sharp portion.

In a swirler according to any one of the preceding thirteen paragraphs, it is preferable that each vane is wedge shaped, and the wedge shaped vanes are arranged in the circle such that the thin ends of the wedge shaped vanes are directed generally radially inwardly, the opposite broad ends of the wedge shaped vanes face generally radially outwardly, and the flow slots defined between adjacent vanes are directed generally radially inwardly.

BRIEF DESCRIPTION OF THE DRAWINGS

The invention will now be described, by way of example, with reference to the accompanying drawings, in which.

DETAILED DESCRIPTION OF INVENTION

Figure 1:
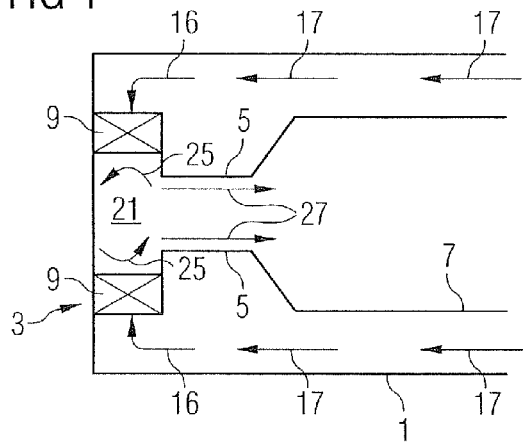
FIG. 1 is a schematic section through a burner for a gas turbine engine, which burner includes a radial swirler in accordance with the present invention.

Referring to FIG. 1, the burner comprises an outer casing 1, a radial swirler 3, a pre-chamber 5, and a combustion chamber 7.

Figure 2:
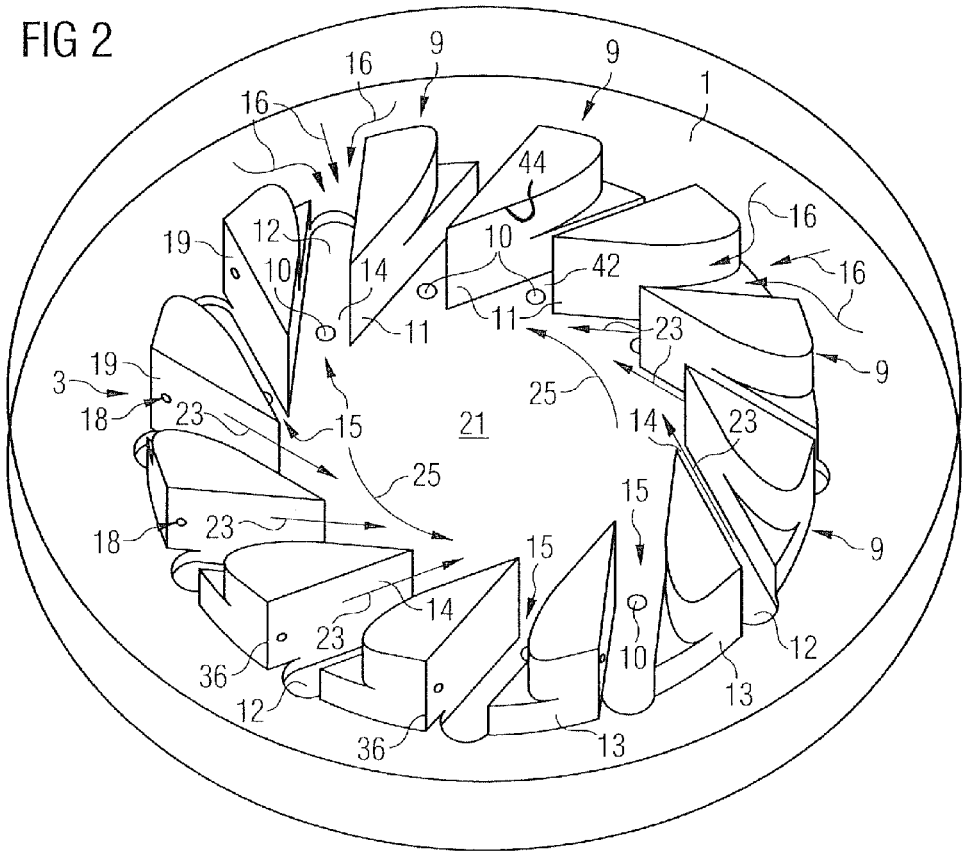
FIG. 2 is a perspective view of the swirler of FIG. 1.

Referring also to FIG. 2, radial swirler 3 comprises a plurality of wedge shaped vanes 9 arranged in a circle. The thin ends 11 of the wedge shaped vanes are directed generally radially inwardly. The opposite broad ends 13 of the wedge shaped vanes face generally radially outwardly. Generally radially inwardly directed straight flow slots 15 are defined between adjacent wedge shaped vanes 9 in the circle. Each flow slot 15 has a base 42 and a top 44 spaced apart in a direction perpendicular to the plane of the circle in which the wedge shaped vanes 9 are arranged. Each flow slot 15 has an inlet end 12 and an outlet end 14.

Compressed air travels in the direction of arrows 17 in FIG. 1 between outer casing 1 and combustion chamber 7/pre-chamber 5. As indicated by arrows 16, the air then turns through 90 degrees so as to enter the flow slots 15 at their inlet ends 12. The air then travels generally radially inwardly along flow slots 15 to their outlet ends 14. Liquid fuel is supplied to flow slots 15 by way of fuel injection holes 10 in the bases 42 of the flow slots. Further, gaseous fuel is supplied to flow slots 15 by way of fuel injection holes 18 in the plane sides 19 of the wedge shaped vanes 9. The air/fuel mix enters the central space 21 within the circle of wedge shaped vanes 9 generally in the direction as indicated by arrows 23, thereby to form a swirling air/fuel mix 25 in central space 21. As indicated by arrows 27, the swirling air/fuel mix 25 travels along pre-chamber 5 to combustion chamber 7 where it combusts.

Figure 3:
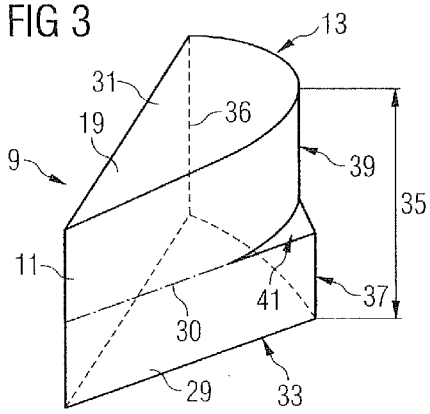
FIG. 3 shows a single wedge shaped vane of the swirler of FIG. 1.

Referring also to FIG. 3, each wedge shaped vane 9 comprises a thin end 11, a broad end 13, a plane side 19, a non-plane side 29, a top face 31, and a bottom face 33. The edge 35 between broad end 13 and non-plane side 29 comprises two portions, a sharp straight lower portion 37 and a smooth curved/profiled upper portion 39. A ledge 41 separates the sharp and smooth portions 37, 39. The edge 36 between broad end 13 and plane side 19 comprises a sharp straight edge.

Another way to describe the wedge shaped vane of FIG. 3 is that it comprises a composite wedge shaped vane comprising a first component wedge shaped vane of conventional form having no smooth curved/profiled edges, and a second component wedge shaped vane of profiled form having the smooth curved/profiled edge 39. In FIG. 3, the first component wedge shaped vane is that part of wedge shaped vane 9 below dotted line 30, and the second component wedge shaped vane is that part of wedge shaped vane 9 above dotted line 30. The difference in the cross sections of the two component vanes (taken in planes parallel to the top and bottom faces 31, 33 of vane 9) creates the ledge 41.

Figure 4:
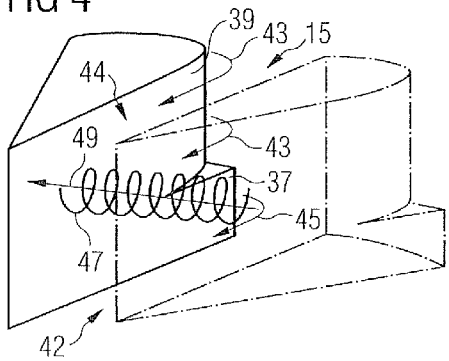
FIG. 4 illustrates the formation of a flow vortex in a flow slot between adjacent wedge shaped vanes of the swirler of FIG. 1.

Referring also to FIG. 4, air entering flow slot 15 around sharp portion 37 of edge 35, see arrow 45, will have a lower inlet velocity to the slot than air entering the slot around smooth portion 39 of edge 35, see arrows 43. The effect of this is to generate a flow vortex 47 that extends along the slot generally radially inwardly whilst at the same time migrating from the base 42 to the top 44 of the slot. The direction 49 of the flow vortex is determined by the length of sharp portion 37 relative to the length of smooth portion 39. The longer the sharp portion relative to the smooth portion, the more rapidly the flow vortex will migrate towards the top of the slot. Thus, the direction of flow vortex 47 can be controlled by varying the relative lengths of the sharp/smooth portions.

The formation of flow vortex 47 can be understood by considering the flow in a flow slot between adjacent wedge shaped vanes of a prior art radial swirler.

Figure 5:
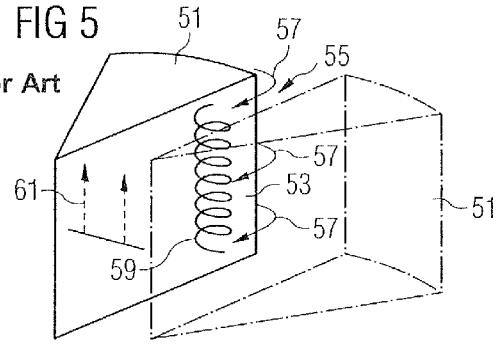
FIG 5 Prior Art
FIG. 5 illustrates the formation of a flow vortex in a flow slot between adjacent wedge shaped vanes of a prior art radial swirler.

Referring also to FIG. 5, the adjacent wedge shaped vanes 51 are the same as the adjacent wedge shaped vanes of FIG. 4 with the exception that they have no smooth portions as portion 39 in FIG. 4. Thus, in wedge shaped vanes 51, a sharp portion 53, as portion 37 in FIG. 4, extends the entire height of the slot 55. In other words, in the wedge shaped vanes of FIG. 5, the edge corresponding to edge 35 in FIG. 3 comprises a single portion only, which is a sharp straight edge 53.

Air entering flow slot 55 around sharp straight edge 53, see arrows 57, will trip over the sharp edge thereby forming a flow vortex 59 which extends vertically up slot 55 immediately beside edge 53. The effect of modifying the wedge shaped vanes of FIG. 5 by the introduction of smooth curved/profiled portions, as portions 39 in FIG. 4, is to forcibly redirect flow vortex 59 in FIG. 5 so that it no longer extends precisely vertically, but extends at an angle to the vertical so as to travel both up the slot and also generally radially inwardly along the slot, as in FIG. 4. In other words, the introduction of a smooth portion, as portion 39 in FIG. 4, to sharp edge 53 in FIG. 5 serves (i) to limit the vertical extent of the sharp edge and thereby also its associated flow trip, and (ii) to provide a current of relatively high velocity air which pushes off vertical the flow vortex generated by the flow trip so that the vortex extends both generally radially inwardly along flow slot 55 as well as up slot 55.

Redirection of the flow vortex of FIG. 5 so that it extends as shown in FIG. 4 is advantageous as regards thoroughness of air/fuel mixing. In the FIG. 5 prior art design it is desirable to assist the liquid fuel injected into a flow slot (by way of fuel injection hole 10) to penetrate the flow in the slot sufficiently to reach the top half 61 of the slot. This is particularly so when the gas turbine engine is operating at part load. Arranging for the flow vortex to extend as shown in FIG. 4 causes fuel to be placed in the top half of the slot, as fuel caught up in the vortex will be carried by the vortex to this top half. Thus, appropriate choice of the relative lengths of the sharp/smooth portions in FIG. 4 enables the direction of extent of the flow vortex to be controlled thereby providing a mechanism by which assistance can be given to the fuel to reach chosen regions of the slot.

Figure 6A:
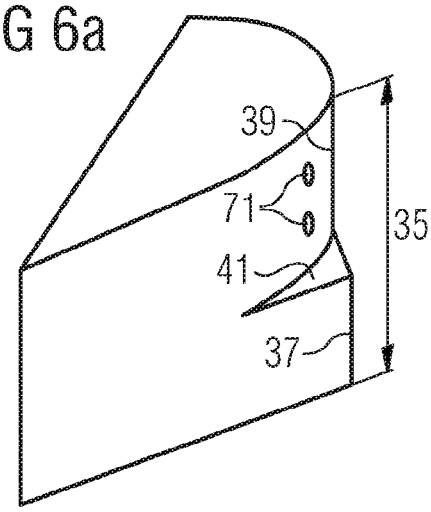
FIGS. 6*a*, 6*b* and 6*c* illustrate wedge shaped vanes as shown in FIG. 3 having different points of introduction of a fuel.
Figure 6B:
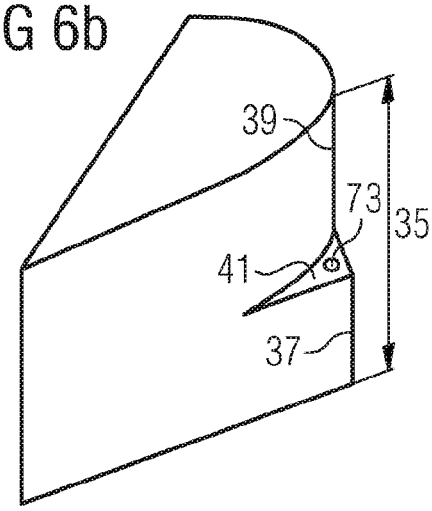
Figure 6C:
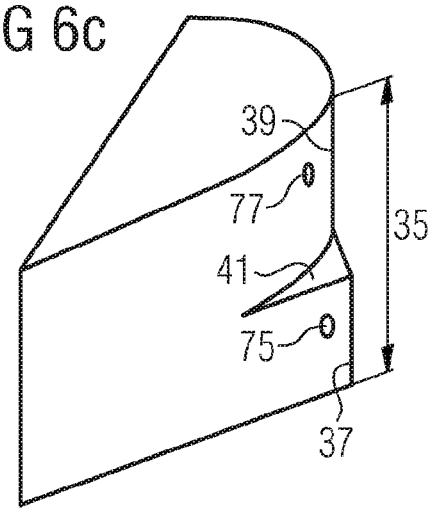

The point at which gaseous fuel is injected into each slot need not be as shown in FIG. 2, i.e. in the plane side 19 of each wedge shaped vane 9 midway along edge 36. Indeed, in order to assist air/fuel mixing of the gaseous fuel, it is desirable to locate the point(s) of injection of the gaseous fuel such that it is very readily caught in flow vortex 47, see FIG. 4. FIGS. 6*a*, 6*b* and 6*c* show suitable points of injection of the gaseous fuel to achieve this. In FIG. 6*a*, two fuel injection holes 71 are located in the smooth portion 39 of edge 35. In FIG. 6*b*, one fuel injection hole 73 is located in the ledge 41 that separates the sharp and smooth portions 37, 39 of edge 35. In FIG. 6*c*, one fuel injection hole 75 is located in sharp portion 37, and another fuel injection hole 77 is located in smooth portion 39.

In the above description, in accordance with the present invention, an edge adjacent an inlet end of a flow slot is configured so as to generate a vortex that extends in a direction desired, so as to carry fuel to a chosen region of the slot. In the above description (i) the edge adjacent is configured to have a sharp lower portion and a smooth upper portion, (ii) the direction desired is from the sharp lower portion to the top of the slot at the slot's exit, and (iii) the chosen region is at the top of the slot at the slot's exit. It is to be appreciated that the edge adjacent may be configured differently to the above description in order to generate a flow vortex (or flow vortices) that extends in a different direction desired, so as to carry fuel to a different chosen region of the slot. FIGS. 7*a* to 7*e* show examples of different configurations of the edge adjacent.

Figure 7A:
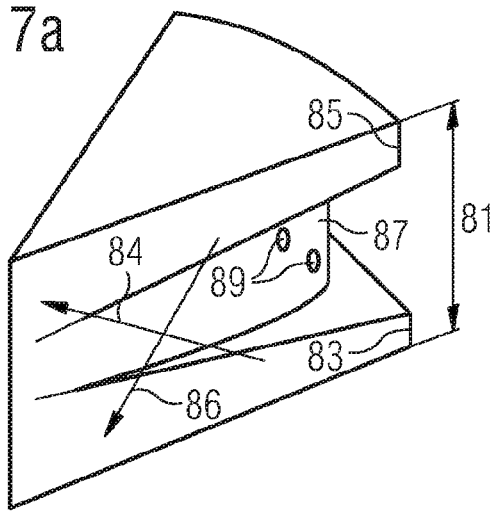
FIGS. 7*a*, 7*b*, 7*c*, 7*d* and 7*e* illustrate wedge shaped vanes of alternative form to that of FIG. 3.

In FIG. 7*a*, the edge adjacent 81 comprises lower and upper sharp straight portions 83, 85, and a central smooth curved/profiled portion 87. Two gaseous fuel injection holes 89 are located in the smooth portion 87. This configuration generates flow vortices that extend in the direction of arrows 84, 86 (compare to arrow 49 in FIG. 4).

Figure 7B:
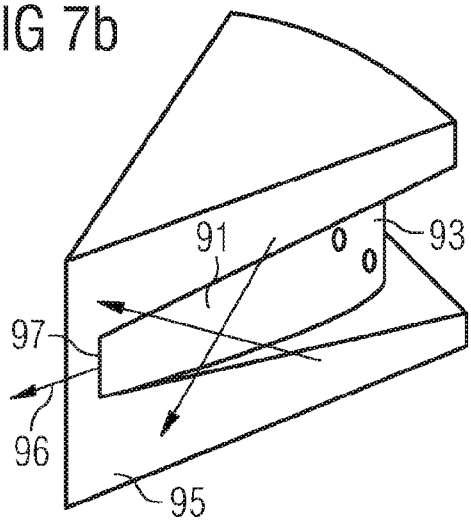

The wedge shaped vane of FIG. 7*b* is the same as that of FIG. 7*a* with the exception that the end of the channel 91 forming the smooth portion 93 does not end flush with side 95 of the wedge shaped vane, as in FIG. 7*a*, but forms an edge/step 97 therewith, which edge/step generates an additional vortex 96 to assist in air/fuel mixing.

Figure 7C:
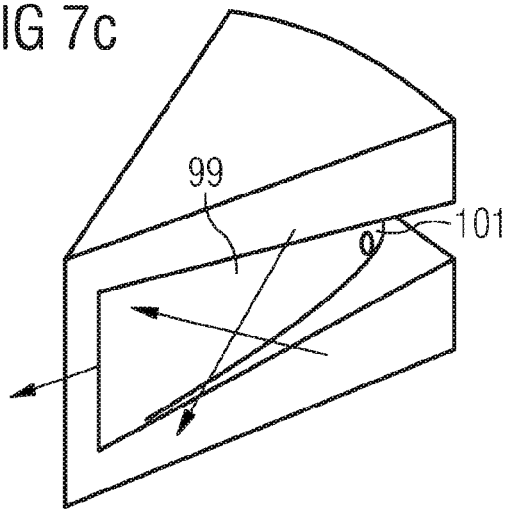

The wedge shaped vane of FIG. 7*c* is the same as that of FIG. 7*b* with the exception that the channel 99 forming the smooth portion 101 increases in width from the inlet to the outlet of the slot rather than decreasing in width as in FIG. 7*b*.

Figure 7D:
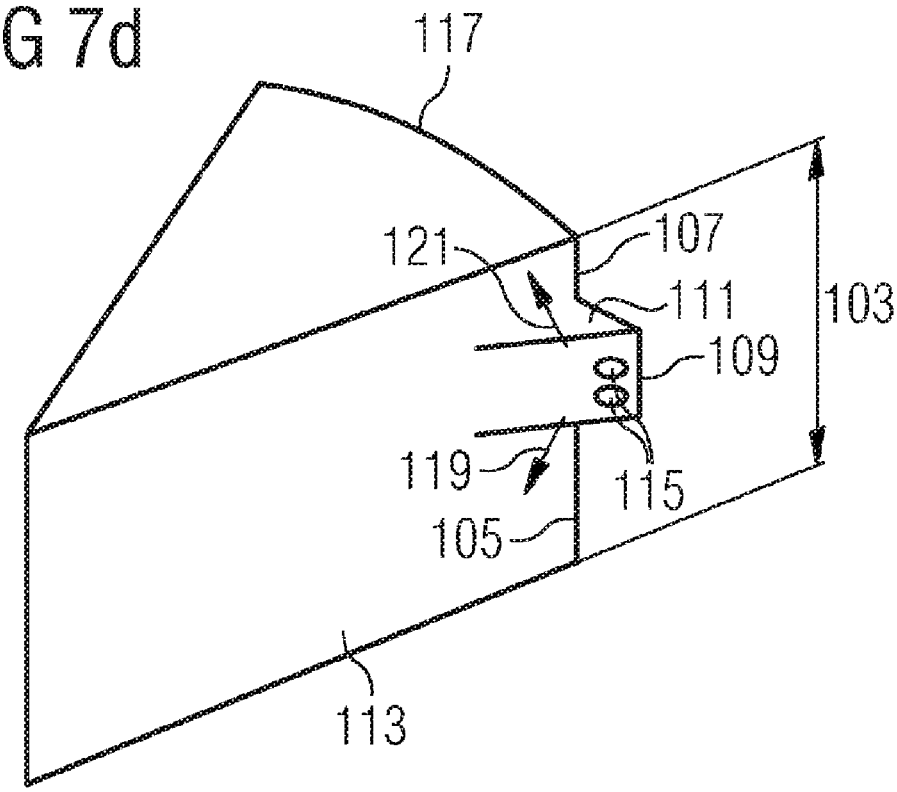

In FIG. 7*d*, the edge adjacent 103 comprises lower and upper sharp straight portions 105, 107, and a further sharp straight portion 109 between portions 105, 107, which further portion 109 is formed by projection 111 on side 113 of the wedge shaped vane. Projection 111 includes two gaseous fuel injection holes 115. Air entering the flow slot around portion 109 will have a lower inlet velocity to the slot than air entering around portions 105, 109, as the air entering around 109 will have had to travel further over the broad end 117 of the wedge shaped vane prior to entering the slot. The vortices generated in the FIG. 7*d* configuration are indicated by arrows 119, 121.

Figure 7E:
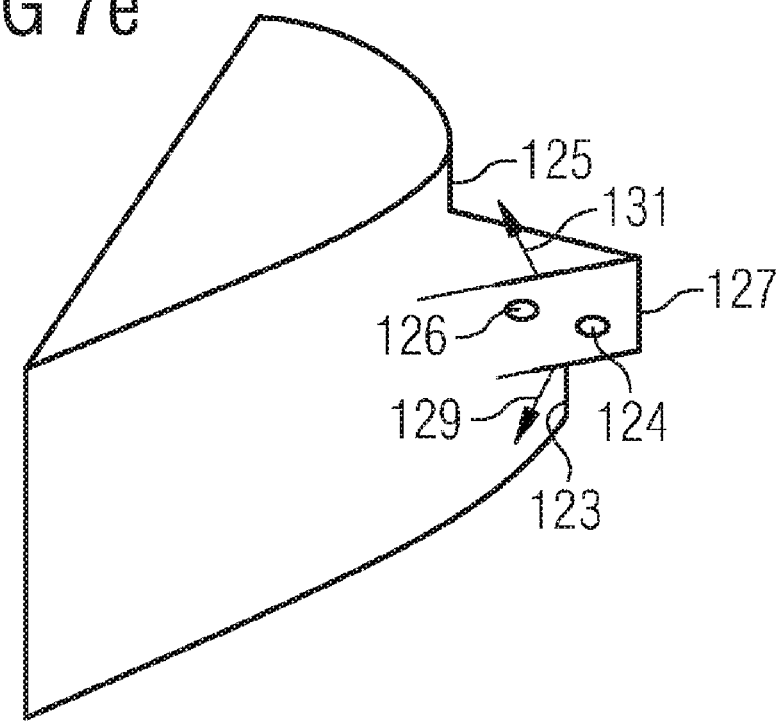

The wedge shaped vane of FIG. 7*e* is the same as that of FIG. 7*d* with the exception that: (i) in the vane of FIG. 7*e* lower and upper sharp straight portions 105, 107 of the vane of FIG. 7*d* are replaced by lower and upper smooth curved/profiled portions 123, 125, the radius of curvature of portion 123 being larger than that of portion 125; and (ii) the two gaseous fuel injection holes 124, 126 of the vane of FIG. 7*e* are staggered. Thus, in the vane of FIG. 7*e*, there are three inlet velocities to the slot, the lowest around sharp straight portion 127, an intermediate velocity around smooth curved/profiled portion 123, and the highest velocity around smooth curved/profiled portion 125. The vortices generated in the FIG. 7*e* configuration are indicated by arrows 129, 131.

The above description relates to a radial swirler. It is to be appreciated that the present invention also extends to axial swirlers. Axial swirlers also comprise a plurality of vanes arranged in a circle, flow slots being defined between adjacent vanes in the circle, each flow slot having an inlet end and an outlet end, in use of the swirler a flow of fuel and air travelling along each flow slot from its inlet end to its outlet end such that the swirler provides a swirling mix of the fuel and air. Use of the present invention in an axial swirler would require at least one vane of the swirler to have an edge adjacent an inlet end of a flow slot that is configured to generate within the flow slot one or more flow vortices that extend along the slot thereby to enhance mixing of the fuel and air travelling along the slot.

It is to be appreciated that the present invention achieves the correct placement of fuel solely by the use of aerodynamic forces. This is to be contrasted to an arrangement wherein control of fuel placement is achieved by the use of multiple fuel injection points having varying rates of injection. Clearly, the present invention is superior as it is less complex and therefore more reliable.

The invention claimed is:

1. A swirler for use in a burner of a gas turbine engine, comprising:

a plurality of vanes arranged in a circle pattern along the burner; and a plurality of flow slots where each slot is defined between adjacent vanes of the circle, each flow slot having an inlet end and an outlet end to direct an air flow towards a central space within the circle, wherein fuel is supplied into the flow slot, such that a mixture of fuel and air enters the central space, wherein at least one vane has a first edge adjacent an inlet end of the flow slot, wherein the first edge adjacent to the inlet end of the flow slot is divided into a plurality of portions along said first edge, including a sharp straight portion and a smooth profiled portion, each portion being configured to provide a respective flow velocity therepast for forcibly redirecting a flow vortex so that the vortex no longer extends substantially parallel to the edge but extends at an angle to the parallel, and wherein the sharp straight portion and the smooth profiled portion are separated by a ledge.

2. The swirler according to claim 1, wherein the sharp straight portion has a substantially smaller length along the first edge that the smooth profiled portion.

3. The swirler according to claim 2, wherein each flow slot has a base and a top that extend between adjacent vanes defining the slot and along the slot from its inlet to its outlet ends, the sharp straight portion of the first edge adjacent the inlet end of the slot being disposed adjacent the base of the slot, the smooth profiled portion of the first edge adjacent the inlet end of the slot arranged adjacent the top of the slot, and wherein fuel is supplied to at least one slot at its base.

4. The swirler according to claim 3, wherein a second edge of each vane is adjacent an inlet end of a further flow slot, the second edge being sharp along its entire length.

5. The swirler according to claim 4, wherein the fuel is supplied to a flow slot from a location along the second edge.

6. The swirler according to claim 4, wherein the fuel is supplied to at least one flow slot from the smooth profiled portion of the first edge adjacent the inlet end of the flow slot.

7. The swirler according to claim 4, wherein the fuel is supplied to at least one flow slot from both the sharp straight portion and the smooth profiled portion of the first edge adjacent the inlet end of the flow slot.

8. The swirler according to claim 4, wherein the fuel is supplied to at least one flow slot from the ledge that separates the sharp straight portion and the smooth profiled portion of the first edge adjacent the inlet end of the flow slot.

9. The swirler according to claim 1, wherein the first edge adjacent the inlet end of the flow slot comprises three portions, having two sharp straight portions separated by a smooth profiled portion, and wherein the fuel is supplied to at least one flow slot from the smooth portion.

10. The swirler according to claim 1, wherein the first edge adjacent the inlet end of the flow slot comprises three portions having two smooth profiled portions separated by a sharp straight portion, and wherein the fuel is supplied to at least one flow slot from the sharp straight portion.

11. The swirler according to claim 10, wherein each vane is wedge shaped, and the wedge shaped vanes are arranged in the circle such that the thin ends of the wedge shaped vanes are directed generally radially inwardly, the opposite broad ends of the wedge shaped vanes face generally radially outwardly, and the flow slots defined between adjacent vanes are directed generally radially inwardly.

* * * * *